US009840867B2

(12) United States Patent
Lukosiunas et al.

(10) Patent No.: US 9,840,867 B2
(45) **Date of Patent: *Dec. 12, 2017**

(54) CORDLESS FABRIC VENETIAN WINDOW SHADE ASSEMBLY

(71) Applicant: Comfortex Window Fashions, Maplewood, NY (US)

(72) Inventors: Sigitas Lukosiunas, Latham, NY (US); Dalton Swearingian, Troy, NY (US)

(73) Assignee: Comfortex Window Fashions, Maplewood, NY (US)

( * ) Notice: Subject to any disclaimer, the term of this patent is extended or adjusted under 35 U.S.C. 154(b) by 33 days.

This patent is subject to a terminal disclaimer.

(21) Appl. No.: 15/005,957

(22) Filed: Jan. 25, 2016

(65) Prior Publication Data

US 2016/0138332 A1 May 19, 2016

Related U.S. Application Data

(63) Continuation of application No. 14/453,057, filed on Aug. 6, 2014, now Pat. No. 9,322,210.

(Continued)

(51) Int. Cl.
*E06B 9/40* (2006.01)
*E06B 9/34* (2006.01)

(Continued)

(52) U.S. Cl.
CPC ..... *E06B 9/34* (2013.01); *E06B 9/26* (2013.01); *E06B 9/262* (2013.01); *E06B 9/388* (2013.01);

(Continued)

(58) Field of Classification Search
CPC ..... E06B 2009/2423; E06B 2009/2435; E06B 2009/2447; E06B 2009/2452;

(Continued)

(56) References Cited

U.S. PATENT DOCUMENTS 1,344,448 A 6/1920 Johnstone
2,175,549 A 10/1939 Nardulli et al.

(Continued)

FOREIGN PATENT DOCUMENTS

CH 696497 A5 12/1978
CN 102733746 A 10/2012

(Continued)

OTHER PUBLICATIONS

Final Office Action for U.S. Appl. No. 14/766,155, dated Jan. 19, 2017, 11 pages.

(Continued)

*Primary Examiner* — Katherine W Mitchell
*Assistant Examiner* — Johnnie A. Shablack
(74) *Attorney, Agent, or Firm* — Matthew J. Kinnier; Hoffman Warnick LLC

(57) ABSTRACT

A fabric venetian window shade assembly including: an actuation system for a double panel window shading including opposing first and second facings coupled by a plurality of vanes, the actuation system comprising: a roller configured to receive the opposing first and second facings; a ratcheting mechanism mechanically coupled to at least the second facing through the roller; and a grip coupled exclusively to a lower end of the second facing, wherein, in response to a downward force being applied to the grip, the downward force is applied directly to the second facing without being applied directly to the first facing, and wherein the ratcheting mechanism is further configured to adjust a position of the opposing first and second facings and an orientation of the plurality of vanes relative to the opposing first and second facings.

18 Claims, 7 Drawing Sheets

Related U.S. Application Data

(60) Provisional application No. 61/867,470, filed on Aug. 19, 2013.

(51) Int. Cl.

| | |
|---|---|
| ***E06B 9/26*** | (2006.01) |
| ***E06B 9/388*** | (2006.01) |
| ***E06B 9/262*** | (2006.01) |
| *E06B 9/322* | (2006.01) |
| *E06B 9/24* | (2006.01) |

(52) U.S. Cl.
CPC ..... *E06B 2009/2435* (2013.01); *E06B 2009/2627* (2013.01); *E06B 2009/3222* (2013.01)

(58) Field of Classification Search
CPC ..... E06B 2009/2458; E06B 9/26; E06B 9/34; E06B 9/388; E06B 9/262; E06B 9/40
USPC ..... 160/84.05, 84.01, 84.04, 84.08, 121.1, 160/349.1, 293.1, 294, 301
See application file for complete search history.

(56) References Cited

U.S. PATENT DOCUMENTS

| | | | | |
|---|---|---|---|---|
| 2,245,902 | A | 6/1941 | Cohen | |
| 2,723,715 | A | 11/1955 | Kauffmann et al. | |
| 2,914,122 | A | 11/1959 | Pinto | |
| 3,384,519 | A | 5/1968 | Froget | |
| 4,194,550 | A | 3/1980 | Hopper | |
| 5,036,898 | A | 8/1991 | Chen | |
| 5,099,906 | A | 3/1992 | Chigusa et al. | |
| 5,123,472 | A | 6/1992 | Nagashima et al. | |
| 5,287,908 | A | 2/1994 | Hoffmann et al. | |
| 5,285,838 | A | 3/1994 | Rapp et al. | |
| 5,301,737 | A | 4/1994 | Martin | |
| 5,309,974 | A | 5/1994 | Fraser | |
| 5,313,999 | A | 5/1994 | Colson et al. | |
| 5,320,154 | A | 6/1994 | Colson et al. | |
| 5,339,882 | A | 8/1994 | Judkins | |
| 5,394,922 | A | 3/1995 | Colson et al. | |
| 5,419,385 | A | 5/1995 | Vogel et al. | |
| 5,421,221 | A | 6/1995 | Warchocki | |
| 5,456,304 | A | 10/1995 | Colson et al. | |
| 5,664,613 | A | 9/1997 | Jelic | |
| 5,690,317 | A | 11/1997 | Sandsborg | |
| 5,855,235 | A | 1/1999 | Colson et al. | |
| 5,888,639 | A | 3/1999 | Green et al. | |
| 6,001,199 | A | 12/1999 | Colson et al. | |
| 6,024,819 | A | 2/2000 | Corey | |
| 6,105,652 | A | 8/2000 | Judkins | |
| 6,112,797 | A | 9/2000 | Colson et al. | |
| 6,116,325 | A | 9/2000 | Colson et al. | |
| 6,142,211 | A | 11/2000 | Judkins | |
| 6,158,563 | A | 12/2000 | Welfonder et al. | |
| 6,164,428 | A | 12/2000 | Berman et al. | |
| 6,171,424 | B1 | 1/2001 | Barss | |
| 6,289,964 | B1 | 9/2001 | Colson et al. | |
| 6,302,982 | B1 | 10/2001 | Corey et al. | |
| 6,377,384 | B2 | 4/2002 | Corey et al. | |
| 6,435,252 | B2 | 8/2002 | Colson et al. | |
| 6,484,786 | B1 | 11/2002 | Ruggles et al. | |
| 6,529,323 | B2 | 3/2003 | Okumura | |
| 6,546,989 | B2 | 4/2003 | Coleman et al. | |
| 6,575,222 | B2 | 6/2003 | Corey et al. | |
| 6,634,409 | B2 | 10/2003 | Corey et al. | |
| 6,688,369 | B2 | 2/2004 | Colson et al. | |
| 6,688,370 | B1 | 2/2004 | Nien | |
| 6,745,811 | B1 | 6/2004 | Nien | |
| 6,782,938 | B2 | 8/2004 | Colson et al. | |
| 6,823,923 | B2 | 11/2004 | Palmer et al. | |
| 6,948,544 | B2 | 9/2005 | Nien | |
| 7,128,121 | B2 | 10/2006 | Nien | |
| 7,267,156 | B2 | 9/2007 | Byeon | |
| 7,311,131 | B2 | 12/2007 | Nien et al. | |
| 7,380,582 | B1 | 6/2008 | Anderson et al. | |
| 7,401,634 | B2 | 7/2008 | Kovach et al. | |
| 7,438,115 | B2 | 10/2008 | Bohlen | |
| 7,500,505 | B2 | 3/2009 | Smith et al. | |
| 7,520,310 | B2 | 4/2009 | Colosio | |
| 7,549,455 | B2 | 6/2009 | Harper et al. | |
| 7,624,785 | B2 | 12/2009 | Yu et al. | |
| 7,836,937 | B2 | 11/2010 | Anderson et al. | |
| 8,281,846 | B2 | 10/2012 | Zhu | |
| 8,327,906 | B2 | 12/2012 | Kwak | |
| 8,356,653 | B2 | 1/2013 | Fu-Lai et al. | |
| 8,418,742 | B2 | 4/2013 | Anderson et al. | |
| 8,517,081 | B2 | 8/2013 | Huang | |
| 8,556,204 | B2 | 10/2013 | Kao | |
| 8,662,139 | B2 | 3/2014 | Anthony et al. | |
| 8,746,320 | B2 | 6/2014 | Yu et al. | |
| 8,763,674 | B2 | 7/2014 | Kataoka et al. | |
| 8,807,192 | B2 | 8/2014 | Marocco | |
| 9,322,210 | B2 | 4/2016 | Lukosiunas et al. | |
| 9,410,366 | B2 | 8/2016 | Kwak | |
| 9,512,672 | B2 * | 12/2016 | Colson | E06B 9/42 |
| 2001/0037864 | A1 | 11/2001 | Colson et al. | |
| 2004/0226663 | A1 | 11/2004 | Smith et al. | |
| 2005/0150608 | A1 | 7/2005 | Auger et al. | |
| 2006/0272783 | A1 | 12/2006 | Smith et al. | |
| 2007/0079943 | A1 | 4/2007 | Smith et al. | |
| 2007/0175595 | A1 | 8/2007 | Lin | |
| 2007/0175596 | A1 | 8/2007 | Chien | |
| 2008/0202709 | A1 | 8/2008 | Anderson et al. | |
| 2009/0223641 | A1 | 9/2009 | Cheng | |
| 2010/0122780 | A1 | 5/2010 | Cheng | |
| 2010/0206495 | A1 | 5/2010 | Lin | |
| 2011/0100568 | A1 | 5/2011 | Kao | |
| 2011/0126959 | A1 | 6/2011 | Holt et al. | |
| 2011/0209836 | A1 | 9/2011 | Yu et al. | |
| 2012/0298318 | A1 | 11/2012 | Wolek | |
| 2014/0138037 | A1 | 5/2014 | Colson et al. | |
| 2014/0216666 | A1 | 8/2014 | Smith et al. | |
| 2014/0262066 | A1 | 9/2014 | Certain et al. | |
| 2014/0262068 | A1 | 9/2014 | Buccola, Jr. et al. | |
| 2014/0262069 | A1 | 9/2014 | Drew et al. | |
| 2015/0007946 | A1 | 1/2015 | Yu et al. | |
| 2015/0034257 | A1 | 2/2015 | Blair et al. | |
| 2015/0034260 | A1 | 2/2015 | Blair et al. | |
| 2015/0047792 | A1 | 2/2015 | Lukosiunas et al. | |
| 2015/0059991 | A1 | 3/2015 | Kwak | |
| 2015/0292261 | A1 | 10/2015 | Chou | |
| 2015/0368966 | A1 * | 12/2015 | Faller | E06B 9/58 160/311 |
| 2016/0010390 | A1 * | 1/2016 | Smith | E06B 9/60 160/302 |
| 2017/0044823 | A1 * | 2/2017 | Colson | E06B 9/42 |
| 2017/0081913 | A1 * | 3/2017 | Chou | E06B 9/264 |

FOREIGN PATENT DOCUMENTS

| | | | |
|---|---|---|---|
| EP | 0705957 | A1 | 10/1996 |
| EP | 0972906 | A1 | 1/2000 |
| EP | 2733302 | A2 | 5/2014 |
| FR | 1521488 | A | 4/1968 |
| JP | 7279560 | A | 10/1995 |
| JP | 8144667 | A | 6/1996 |
| JP | 9170390 | A | 6/1997 |
| JP | 2008188470 | A | 8/2008 |
| JP | 2008231913 | A | 10/2008 |
| KR | 1020060066012 | A | 6/2006 |
| KR | 100675556 | B1 | 1/2007 |
| KR | 100943408 | B1 | 2/2010 |
| KR | 20110139082 | A | 12/2011 |
| KR | 101259614 | B1 | 5/2013 |
| WO | 9937876 | A1 | 7/1999 |
| WO | 2010041880 | A1 | 4/2010 |
| WO | 2012006514 | A2 | 1/2012 |
| WO | 2013033014 | A1 | 3/2013 |
| WO | 2014115684 | A1 | 7/2014 |
| WO | 2014143057 | A1 | 9/2014 |

(56) References Cited

FOREIGN PATENT DOCUMENTS

| | | | |
|---|---|---|---|
| WO | 2014163602 | A2 | 10/2014 |
| WO | 2014201253 | A2 | 12/2014 |
| WO | 2015030349 | A1 | 5/2015 |

OTHER PUBLICATIONS

Patent Cooperation Treaty, Notification of Transmittal of the International Search Report and the Written Opinion of the International Searching Authority for PCT/2013/032634 dated Jun. 5, 2013, 4 pages.
Patent Cooperation Treaty, Notification of Transmittal of the International Search Report and the Written Opinion of the International Searching Authority for PCT/US2014/051509 dated Jan. 22, 2015, 19 pages.
Shablack. Office Action Communication for U.S. Appl. No. 14/453,057, dated Nov. 10, 2015, 28 pages.
Shablack, Notice of Allowance and Fee(s) Due for U.S. Appl. No. 14/453,057, dated Mar. 9, 2016, 15 pages.

* cited by examiner

CORDLESS FABRIC VENETIAN WINDOW SHADE ASSEMBLY

This application is a continuation of U.S. patent application Ser. No. 14/453,057, filed Aug. 6, 2014, which claims priority to previous U.S. Provisional Patent Application No. 61/867,470, filed Aug. 19, 2013, both of which are hereby incorporated by reference.

BACKGROUND

1. Technical Field

The present disclosure relates to window shades, and more particularly, to a cordless fabric venetian window shade assembly. An actuation system of the window shade assembly can include a spring-loaded ratchet system.

2. Background Art

Conventional venetian window shades include those as described in: U.S. Pat. No. 3,384,519 to Froget; FR1,521,488 to Demerson; U.S. Pat. Nos. 5,287,908, 5,313,999, 5,320,154, 5,394,922 and 5,456,304, all assigned to Hunter Douglas, Inc.; and U.S. Pat. No. 5,339,882 to Ren Judkins; U.S. Pat. No. 5,664,613 to Ralph Jelic, now assigned by acquisition to the present applicant's assignee Comfortex Window Fashions; U.S. Pat. No. 5,888,639 assigned to Newell Operating Co.; and U.S. Pat. Nos. 6,024,819; 6,171,424; 6,302,982; 6,377,384; 6,575,222; and 6,634,409 all assigned to the present application's assignee Comfortex Window Fashions, all of which are hereby incorporated by reference.

Conventional fabric venetian window shade assemblies may include a roller that is mounted to a headrail and headrail to the wall or window frame in conventional manner. The fabric venetian window shade itself comprises a first, back fabric facing or layer and a second, front fabric facing or layer. Each fabric facing is usually of high transparency. A plurality of vanes, typically of less translucent fabric, are attached at regular intervals to each fabric facing. The window shade is mounted to the roller such that when the roller is rotated to a first position, the two fabric facings hang from opposite sides of the roller, spaced apart and with the vanes extending between them in an orientation substantially perpendicular to both facings' planes, thus providing maximum view-through. When the roller is rotated in a first direction, it lowers the second, inner fabric facing (which may face internally toward the inside of the room where the shade is hung), and raises the other, first or 'outer' facing (which may face externally toward the window). The first effect of such rotation is to close the fabric vanes and bring the vanes and the two facings close together and parallel, to approximate a single quilted fabric. Further rotation of the roller in the same direction can then roll the flattened fabric onto the roller, lifting it from the window area as in a conventional roller shade. Unrolling the shade again reverses this process, with the flattened fabric first lowering to cover the window area, then, with a final partial turn of the roll, separating the first and second facings and tilting the vanes therebetween to provide view-through. Conventionally, this type of shade includes a single, rigid bottom rail connecting the lower, free ends of the facing fabrics. The single bottom rail acts to maintain the facings in smooth, level planes, by tension, and induces the vanes to flex as needed for their tilting by providing additional weight.

Most window shades (e.g., roller, cellular, pleated, or fabric-venetian) can be operated with a cord system, e.g., a cord lock with a pull cord, or a loop cord with a clutch and roller positioned at the top of the assembly. In particular, fabric venetians (sometimes called 'window shadings' or 'window shade assemblies') such as the Shangri-La™ by Comfortex or Silhouette™ by HunterDouglas, can provide specialty roller shades with multi-layered fabric that includes inner tiltable fabric vanes. These assemblies may include a loop-cord and clutch system to perform a roll rotation which actuates the tiltable vanes once the shade has reached full extension. These clutch systems are typically fitted to the end of the roller, outboard of the fabric width. As a result, the assembly may include an unsightly and undesirable gap located between the edge of the fabric and window opening. This gap may be especially problematic to opaque, light-blocking shade styles because light can travel through the gap between the window and the shade fabric.

Conventional window shade assemblies with cords may also create significant safety hazards. For example, cords and cord loops of conventional window shade assemblies may entangle young children playing in an environment which includes the corded window shade assembly. Many alternative systems without cords and cord loops have been proposed, but most are significantly more expensive than existing window shade assemblies. Actuating the shade with motorized components can also potentially eliminate the presence of cords, in addition to providing other benefits such as remote control or timer-driven deployment, but these alternatives are also more expensive than conventional assemblies. In addition, systems which can fit in place of (i.e., substitute for) the manual clutch and cord-loop most commonly used on large (more costly) shades. The cost of these motors is often as much as that of the shade itself and so these have been restricted to only the most expensive of applications. Further, because the motors fit where clutches would otherwise go, they do not improve the side gap characteristic of the clutch systems.

In conventional roller shades, a spring-balanced ratchet is commonly used. The spring-balanced ratchet can allow the bottom of the shade to be gripped by a user, pulled downward to a length beyond the desired deployment position, and slowly released to set a ratchet that catches the roller against a torsion spring in the roller. The ratchet can be energized by the rotation of the roller when the shade is pulled out. Such an actuator is inexpensive, intuitive to use, and safe. It has not been previously used with fabric venetians because motorized alternatives are installed where existing cords and clutches would be used to pull the shade beyond the desired extension to set (or release) the ratchet. In a conventional roller shade (with simple, single-layer fabric), there is no barrier to providing more fabric length than the window height to enable such over-draw, even when the desired holding position is equal to the entire window height. However, in a fabric venetian shade, this is not possible, because the exact fabric length must be provided to precisely match the window height, so that the final rotation of the roller provides the vane tilting and does not puddle excess fabric on the sill in such configuration. Although it is possible (if the fabric is not too long) to grip the bottom rail and pull down on its back edge (attached to the outer facing) while pushing upward on the inner edge (attached to the inner facing) in order to effect the tilting of the vanes, after the shade fabric is fully extended, such a motion is uncomfortable and unnatural. This motion may be especially inconvenient after merely pulling downward initially for the main deployment. These conventional shades may also continue to include a large gap between the window and the window shade fabric.

BRIEF SUMMARY

A first aspect of the disclosure provides an actuation system for a fabric venetian window shade having a pair of opposing first and second facings coupled by a plurality of vanes, the actuation system comprising: a roller configured to receive the fabric venetian window shade; a spring-loaded ratchet operatively coupled to the roller; a first weighted rail attached to a lower edge of the first facing; and a second weighted rail attached to a lower edge of the second facing, wherein the first weighted rail and the second weighted rail are separate.

A second aspect of the disclosure provides a fabric venetian window shade assembly including: a fabric venetian window shade including a pair of opposing first and second facings coupled by a plurality of vanes; an actuation system including: a roller configured to receive the fabric venetian window shade; a spring-loaded ratchet operatively coupled to the roller; a first weighted rail attached to a lower edge of the first facing; and a second weighted rail attached to a lower edge of the second facing, wherein the first weighted rail and the second weighted rail are separate.

A third aspect of the invention includes an actuation system for a fabric venetian window shade having a pair of opposing first and second facings coupled by a plurality of vanes, the system comprising: a ratchet system operatively coupled to a roller to which the fabric venetian window shade is rollably attached, the ratchet system operable to position the fabric venetian window shade in a plurality of positions including: a retracted position in which the fabric venetian window shade is fully rolled onto the roller; a plurality of partially deployed, non-transparent positions in which the fabric venetian window shade is partially deployed from the roller and the first and second facings are substantially parallel with the plurality of vanes so the window shade is non-transparent; a fully deployed, non-transparent position in which the window shade is fully deployed from the roller and the first and second fabric faces and the plurality of vanes are substantially parallel so the window shade is non-transparent; and a plurality of fully deployed, at least partially transparent positions in which the fabric venetian window shade is fully deployed from the roller and the first and second fabric faces are not parallel with the plurality of vanes so the window shade is at least partially transparent.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

Embodiments of the present disclosure provide a cordless actuator assemblies for window shades. In particular, embodiments of the present disclosure combine the safety of cordless shades with a slip clutch for roller rotation beyond full-length deployment to tilt a set of internal fabric vanes. Embodiments of the present disclosure can also eliminate undesirable gaps between the shade edge and the window opening found in conventional, cord-based systems. This result is achieved with low cost and minimal installation volume (space), and can be a viable alternative for most cord-type fabric venetian shade actuators.

Figure 1:
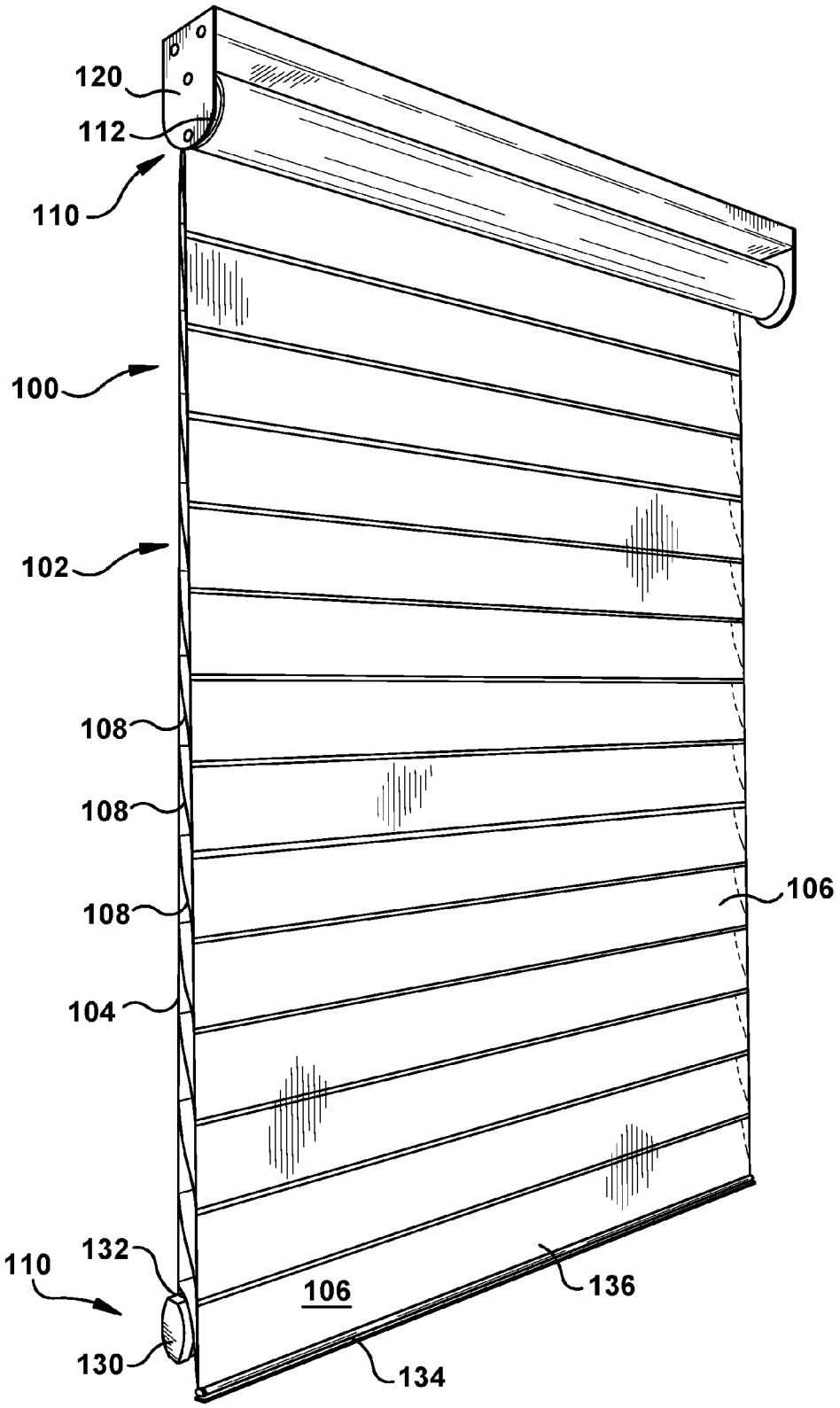
FIG. 1 shows a perspective view of a fabric venetian window shade assembly in a fully deployed, non-transparent position according to embodiments of the present disclosure.

Embodiments of the invention include a fabric venetian window shade assembly and an actuation system therefor. As shown in FIG. 1, embodiments of the present disclosure implement an actuation system including a roller and a specialized ratchet for fabric venetian window shadings, including fabric venetian window shadings. In particular, embodiments of the present disclosure include a spring-loaded ratchet coupled to a roller for the window shade, and two separate weighted rails attached to one corresponding fabric facing. The weighted rails can provide increase the rigidity and weight of the assembly, such that the rails hold each facing taut when the window shade is unrolled from the roller. The position approximately where a conventional rail would attach to both facings still provides a net falling weight sufficient to actuate the vanes of the shade when the roller makes its last turn. However, the separation between the two weighted rails allows a user to grip the back (outer rail) alone and pull it downward for the entire actuation of the shade, whether during an unrolling of the shade fabric or the last, vane-tilting roller rotation.

As shown in FIG. 1 and discussed herein, a spring-loaded ratchet can be positioned inside of the roller to hold the fabric facings in any desired amount of deployment from the roller, and to retract the fabric back onto the roller. To improve the function and operability of the roller, embodiments of the present disclosure also include attaching the fabric to the roller only at or near the tangency of the inner facing that occurs when the vanes are in a substantially horizontal position (e.g., perpendicular to the facings for maximum transparency). As a result, a user can pull the outer (back) bottom weighted rail downward, past the normal maximum condition (i.e., vanes substantially horizontal, maximum transparency), with another downward pull to set or release the ratchet in the roller. A view-through (substantially transparent) position can be achieved comfortably with the shade extending through exactly the full length of the corresponding window height. The ratchet can also include stops spaced no farther apart than the roller rotation angle associated with an over-draw length to enable an over-pulling motion to set or release the ratchet. The spacing of stops can also vary depending on the width of the vanes and the diameter of the roller. In a particular embodiment, the ratchet can include multiple stops within a single complete rotation, thereby allowing the vanes to be set at intermediate angles between fully open (i.e., substantially transparent) and shut (i.e., an opaque setting which approximates a flattened fabric).

As shown in FIG. 1, a window shade assembly 100 according to embodiments of the present disclosure is shown. Window shade assembly 100 may be embodied as a fabric venetian window shade. A venetian window shade refers to a window shade composed of several horizontal shade bars. As examples, window shade assembly 100 can include one or more window shades 102 composed of wood, plastic, a fabric, a composite material, or any other currently known or later developed type of shading material (whether substantially transparent, translucent, or opaque). Window shade assembly 100 can include a first facing 104 and an opposing second facing 106 coupled by a plurality of vanes positioned therebetween. As shown by example in FIG. 1, first and second facings 104, 106 can be oriented in a substantially vertical position, with vanes 106 being substantially horizontal to join first and second facings 104, 106 to each other. In the example of FIG. 1, vanes 106 are positioned substantially parallel to the corresponding window in a "closed" position. Embodiments of the present disclosure include a structure and method for adjusting the position of first and second facings 104, 106, e.g., by rotationally positioning first and second facings 104, 106 to transmit or substantially prevent the passage of light through window shade assembly 100.

Figure 2:
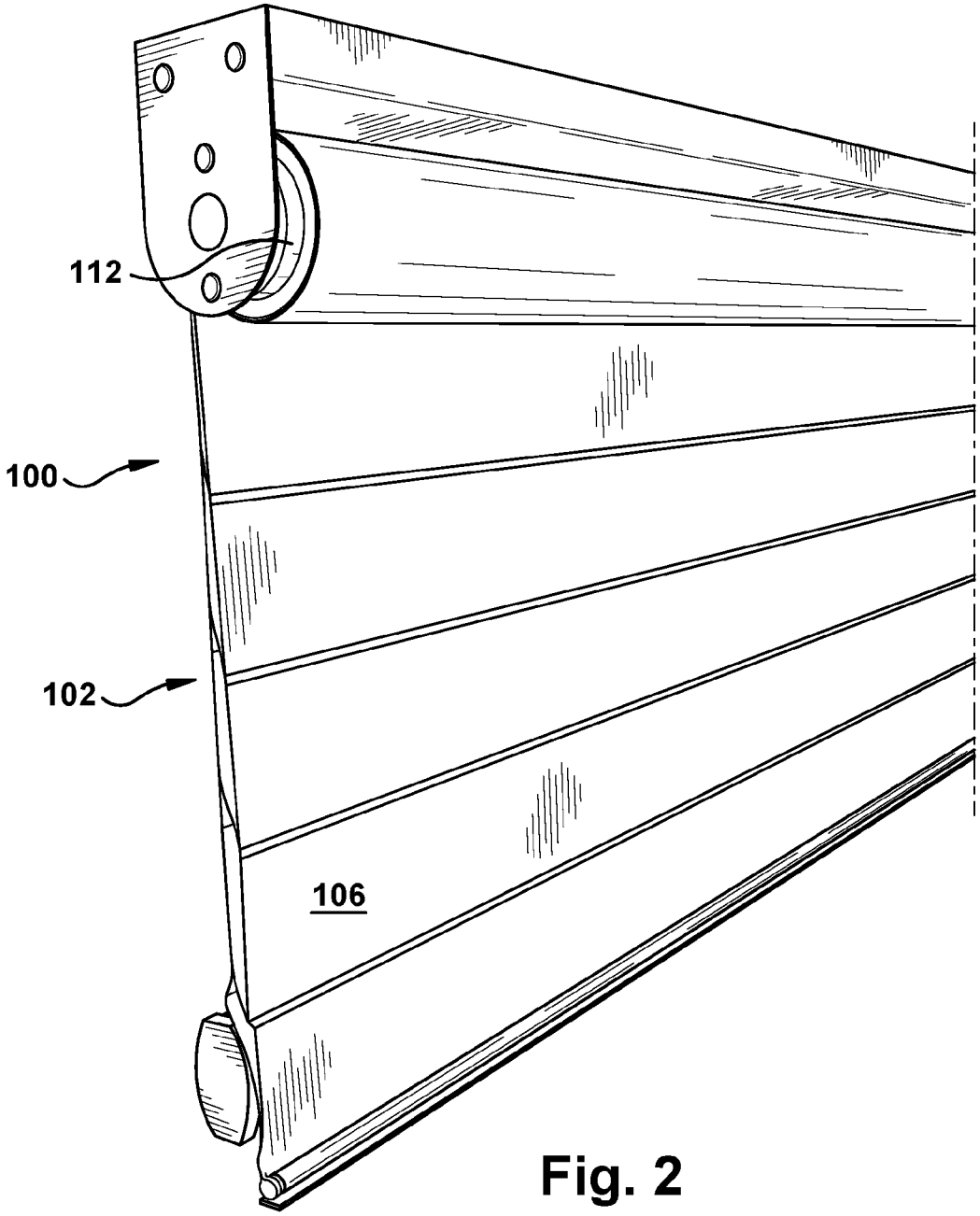
FIG. 2 shows an enlarged perspective view of a fabric venetian window shade assembly in one of a plurality of partially deployed, non-transparent positions according to embodiments of the present disclosure.

Turning to FIG. 2, an actuation system 110 can secure window shade assembly 100 to a surface of interest, such as a wall above a window and/or a window shade bracket mounted thereon. In embodiments of the present disclosure, actuation system 110 can include a roller 112 configured to retain window shade 102 in a retracted position, and from which window shade 102 can be unrolled to cover a corresponding area, window, etc. Roller 112 may have a diameter that is substantially identical to a width of each of plurality of vanes 108, (i.e., the distance of a side of vane 108 separating first and second facings 104, 106) but this is not necessary in all instances. Actuation system 110 can include a spring-loaded ratchet 120 located, e.g., within the brackets of the headrail assembly for window shade 102 and operably connected to roller 112. As is shown in FIG. 2-6, Spring-loaded ratchet 120 positions roller 112 and fabric venetian window shade 102 in a plurality of positions. As is discussed in further detail herein, FIG. 6 shows a retracted position in which fabric venetian window shade 102 is fully rolled onto roller 112. FIG. 2 shows one of a plurality of partially deployed, non-transparent positions in which fabric venetian window shade 102 is partially deployed from roller 112 and first and second fabric facings 104, 106 are substantially parallel with the plurality of vanes 108 so the window shade is non-transparent. In this position, shade 102 acts to block the highest amount of light possible for the amount of window that it is extended in front of, but does not fully cover the window. FIG. 1 shows a fully deployed, non-transparent position in which fabric venetian window shade 102 is fully deployed from roller 112 and first and second fabric faces 104, 106 and the plurality of vanes 108 are substantially parallel so the window shade is non-transparent. In this position, shade 102 can block the highest amount of light possible for the entire window where shade 102 is used.

The spring of spring-loaded ratchet 120 can expand as window shade 102 is pulled from roller 112 until the withdrawn length of window shade 102 reaches or exceeds a setting length. At this point, a catch point of the ratchet element of spring-loaded ratchet 120 can set, thereby holding the withdrawn window shade 102 in place. Through the setting of spring-loaded ratchet 120, window shade 102 can remain in place after being withdrawn from roller 112 as shown in FIG. 1. FIGS. 3, 4, 5 and 7 show a plurality of fully deployed, at least partially transparent positions in which fabric venetian window shade 102 is fully deployed from roller 112. These figures also show instances where first and second fabric faces 104, 106 are not parallel with plurality of vanes 108 so the window shade is at least partially transparent. As shown best in FIG. 7, in these positions, fabric venetian window shade 102 is attached to roller 112 at a single bond line 140 substantially at a tangency of one of the first and second fabric facings 104, 106 (104 as illustrated) only when the plurality of vanes are positioned substantially perpendicular to planes of the first and second fabric facings 104, 106. The diameter of roller 112 and a spacing of catches of spring-loaded ratchet 120 can have predetermined values relative to the width of vanes 108. These predetermined values can be chosen to cause at least one catch and release setpoint of spring-loaded ratchet 120 to occur within a full rotation of roller 112. The ratchet element of spring-loaded ratchet 120 can also release when the corresponding spring is pulled to a predetermined distance after being set (i.e., over-draw). Actuation system 110 can therefore allow window shade 102 to return to roller 112 without the use of a cord loop, e.g., by releasing spring-loaded ratchet 120.

Figure 3:
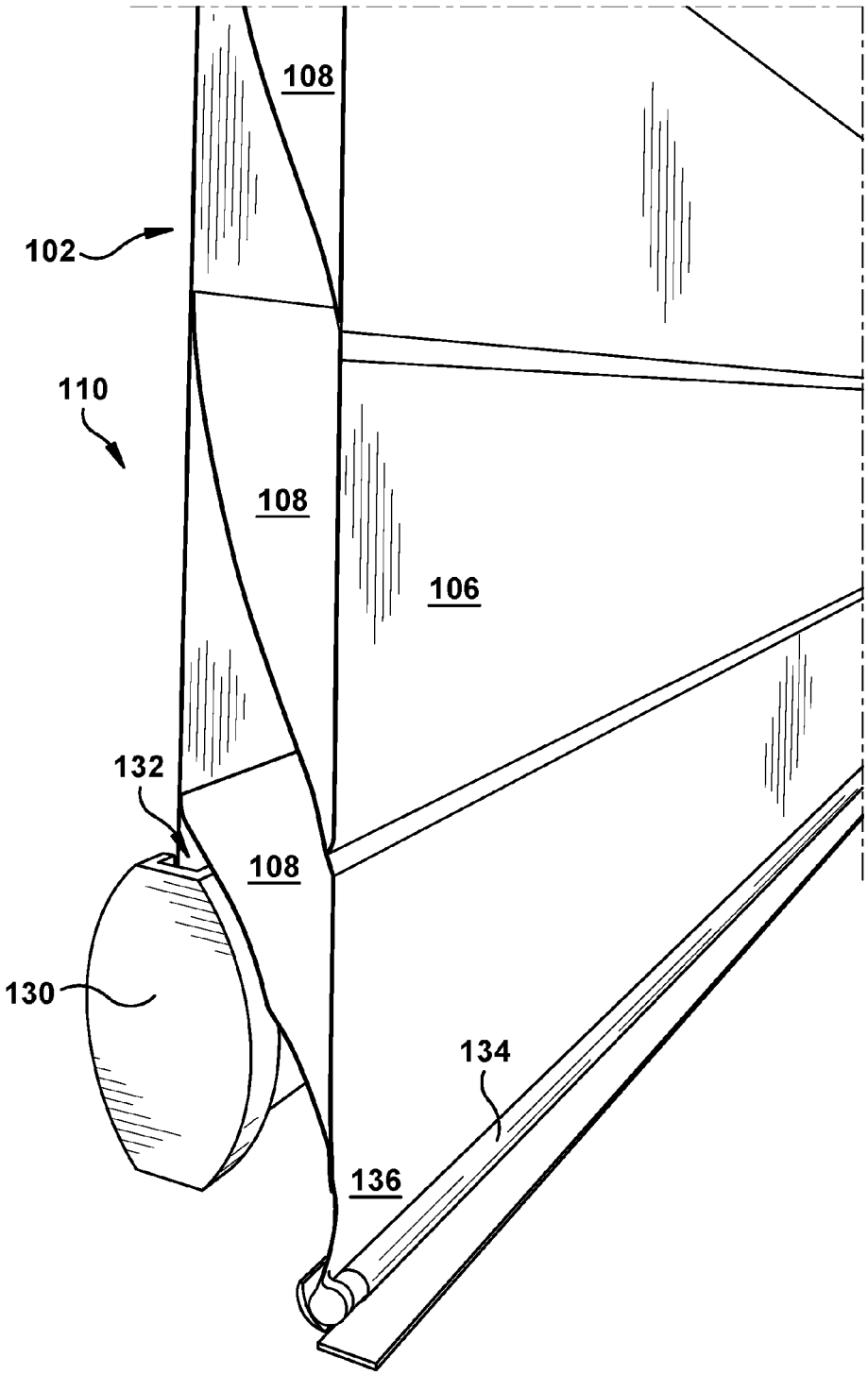
FIG. 3 shows a perspective view of a fabric venetian window shade assembly in one of a plurality of fully deployed, at least partially transparent positions (mostly non-transparent) according to embodiments of the present disclosure.

As shown in FIG. 3, actuation system 100 may also include a first weighted rail 130 attached to a lower edge 132 of first, rear fabric facing 104; and a second weighted rail 134 attached to a lower edge 136 of the second fabric facing 106. As illustrated, first weighted rail 130 and second weighted rail 134 are separate. First weighted rail 130 may be larger than second weighted rail 134, e.g., in size and/or weight. This is in contrast to conventional systems that employ a single weighted rail for reasons described herein. A lower edge 132 of first facing 104 opposing actuation system 110 can include first weighted rail 130. First weighted rail 130 can include a shell composed of a different material from the remainder of window shade 102, such as a plastic, metal, ceramic, or composite material. The shell of first weighted rail 130 can increase the size and/or weight of first weighted rail 130 in addition to providing a grip for users of window shade assembly 100. First weighted rail 130, in contrast to rails of other window shade assemblies, can be coupled exclusively to lower edge 132 of first facing 104 (or alternatively lower edge 134 of second front facing 106) without being coupled to the other facing. Thus, a user of window shade assembly 100 can pull on first weighted rail 130 to retract window shade 102 into roller 112 and/or switch vanes 108 from being opened or closed without applying a force to second facing 106.

As shown in FIG. 3, a lower edge 134 of second facing 106 can include second weighted rail 136. Second weighted rail 136 can include a shell composed of a different material than window shade 102, e.g., a plastic, metal, ceramic, or composite material. The shell of second weighted rail 136 can provide an offsetting weight to first weighted rail 130 while providing another grip independent of first weighted rail 130. Second weighted rail 136 can be coupled exclusively to lower edge 134 of second facing 106 without being coupled to the other facing (e.g., first facing 104). A user of window shade assembly 100 can pull second weighted rail 136 to unroll window shade 102 from roller 112 to set a catch point of spring-loaded ratchet 120. Alternatively, first weighted rail 132 and second weighted rail 136 can perform opposite and/or additional functions from those described herein. First weighted rail 134 and second weighted rail 136 can be separate, distinct components, with different sizes. For example, second weighted rail 136 can be larger than first weighted rail 130. Applying a force to first facing 104 via first weighted rail 130 can result in substantially no direct force to be applied to the opposing second facing 106, and applying a force to second facing 106 via second weighted rail 136 can result in substantially no direct force to be applied to the opposing first facing 104.

Figure 4:
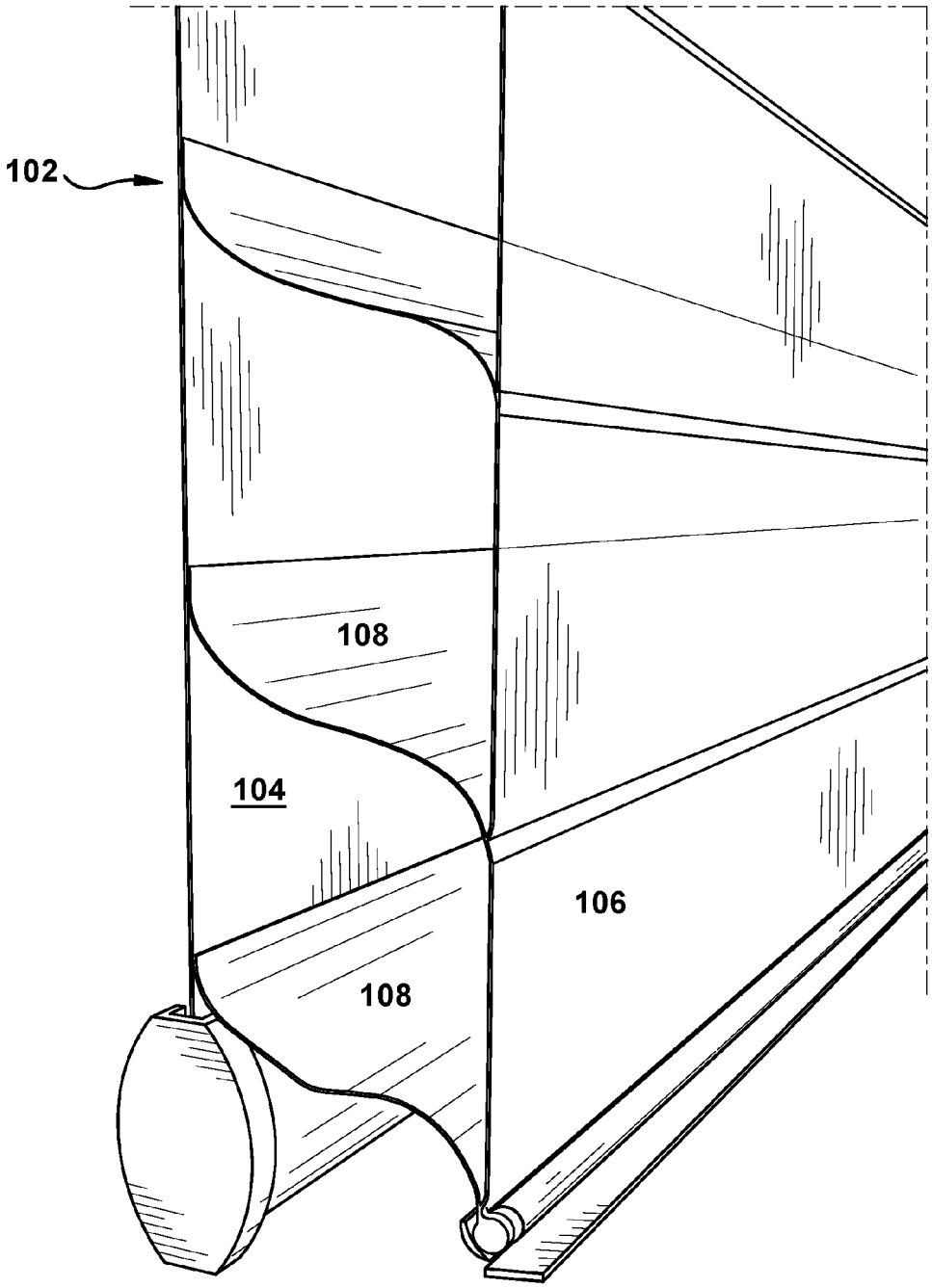
FIG. 4 shows a perspective view of a fabric venetian window shade assembly in one of a plurality of fully deployed, at least partially transparent positions (mostly transparent) according to embodiments of the present disclosure.

Referring to FIGS. 3 and 4 together, a mostly non-transparent position of window shade assembly 100 is shown in FIG. 3 and a mostly transparent position of window shade assembly is shown in FIG. 4. Applying a force to second weighted rail 136 can unroll window shade 102, from window shade 102 being almost entirely on roller 112, into a deployed or partially deployed position in which window shade 102 is unrolled from roller 112. After window shade 102 is unrolled, vanes 108 can be oriented substantially in parallel with first and second facings 104, 106, such that window shade 102 is substantially opaque or translucent. A user can apply a force (e.g., pull) first weighted rail 130 to actuate spring-loaded ratchet 120 of actuation system 110. Pulling first weighted rail 130 can set the ratchet element of spring-loaded ratchet 120, and first facing 104 can move to a lower position in closer horizontal alignment with second facing 106. The closer horizontal alignment can cause vanes 108 to be substantially perpendicular to the planes of first and second facings 104, 106, such that window shade assembly 100 is substantially translucent or transparent with respect to light passing therethrough.

Figure 5:
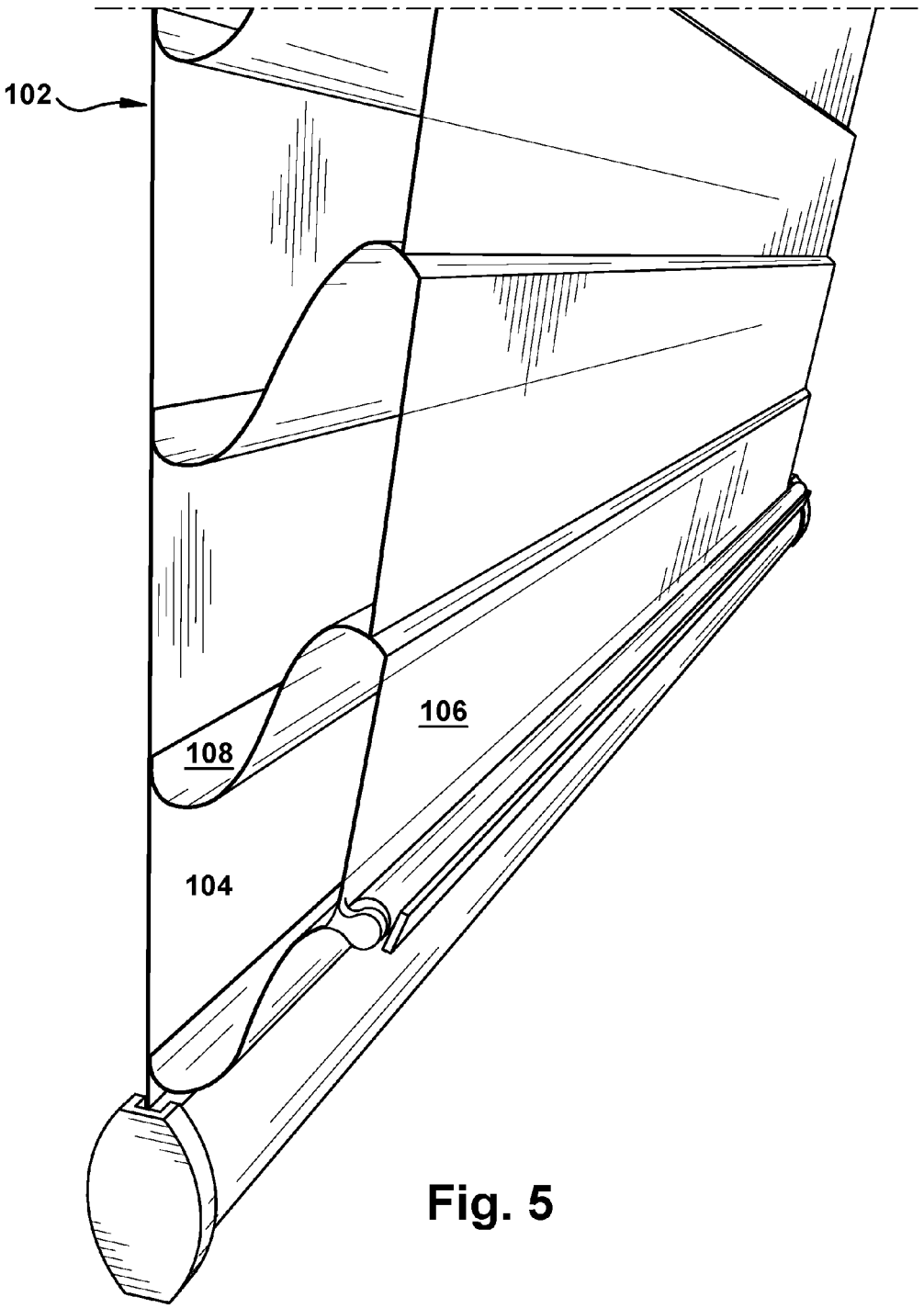
FIG. 5 shows a perspective view of a fabric venetian window shade assembly in one of a plurality of fully deployed, at least partially transparent positions being activated for retraction to a retracted position according to embodiments of the present disclosure.
Figure 6:
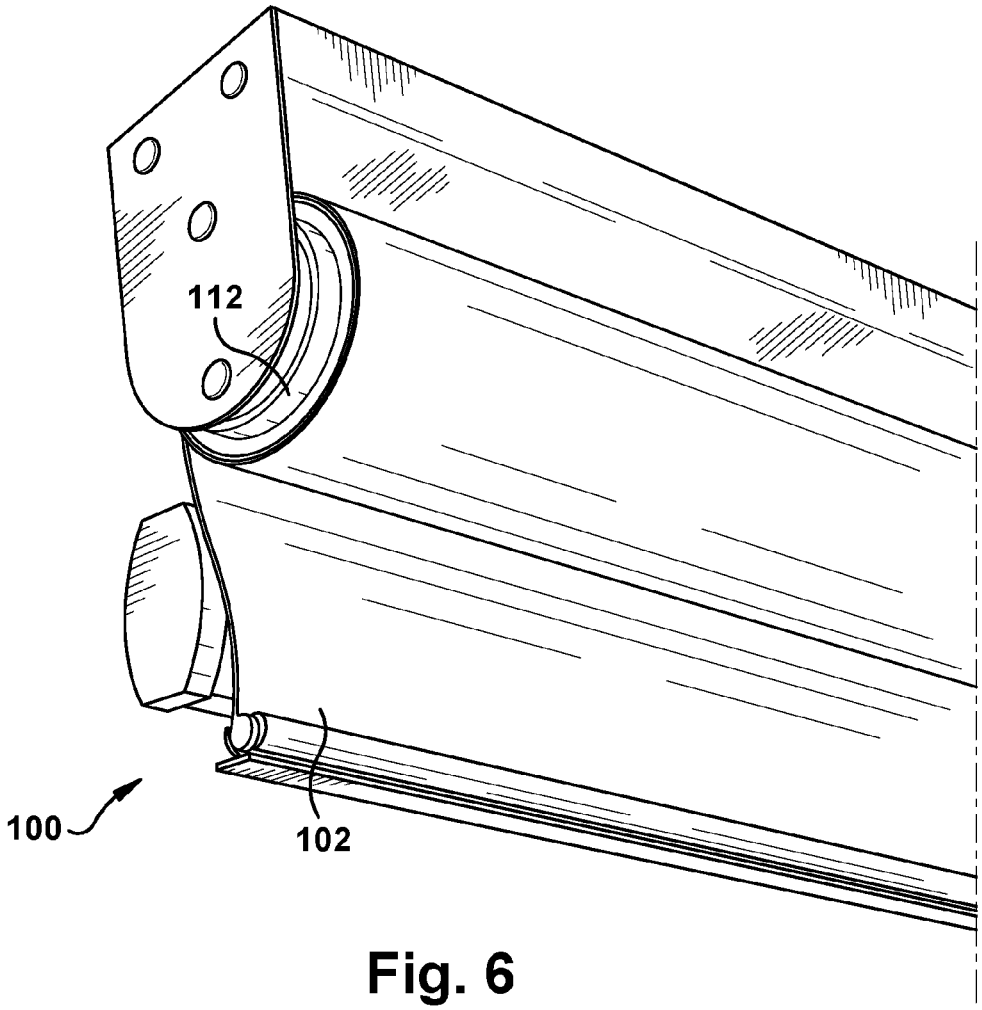
FIG. 6 shows a perspective view of a fabric venetian window shade assembly in a retracted position according to embodiments of the present disclosure.

Turning to FIG. 5, applying a force to (i.e., pulling) first weighted rail 130 after vanes 108 are opened can release spring-loaded ratchet 120 (FIGS. 1, 2), compressing the spring element therein to pull window shade 102 back onto roller 112. To release spring-loaded ratchet 120, a user can apply a force to first weighted rail 130 to pull the ratchet element of spring-loaded ratchet 120 to a release position. The release position may correspond to, e.g., first weighted rail 130 being unrolled to a position below second weighted rail 136 (over-draw). As shown in FIG. 6, spring-loaded ratchet 120 can be released from its set position by the force applied to first weighted rail 130 to compress the spring element of spring-loaded ratchet 120, pulling window shade 102 onto roller 112. Thus, pulling first weighted rail 130 (FIG. 5) or second weighted rail 136 (FIG. 5) can perform different functions when window shade 102 is unrolled from roller 112. For example, pulling first weighted rail 130 (FIG. 5) can retract window shade 102 into roller 112, and pulling second weighted rail 136 (FIG. 5) can adjust the orientation of vanes 108 (FIG. 5) such that window shade 102 either substantially transmits or blocks light.

Figure 7:
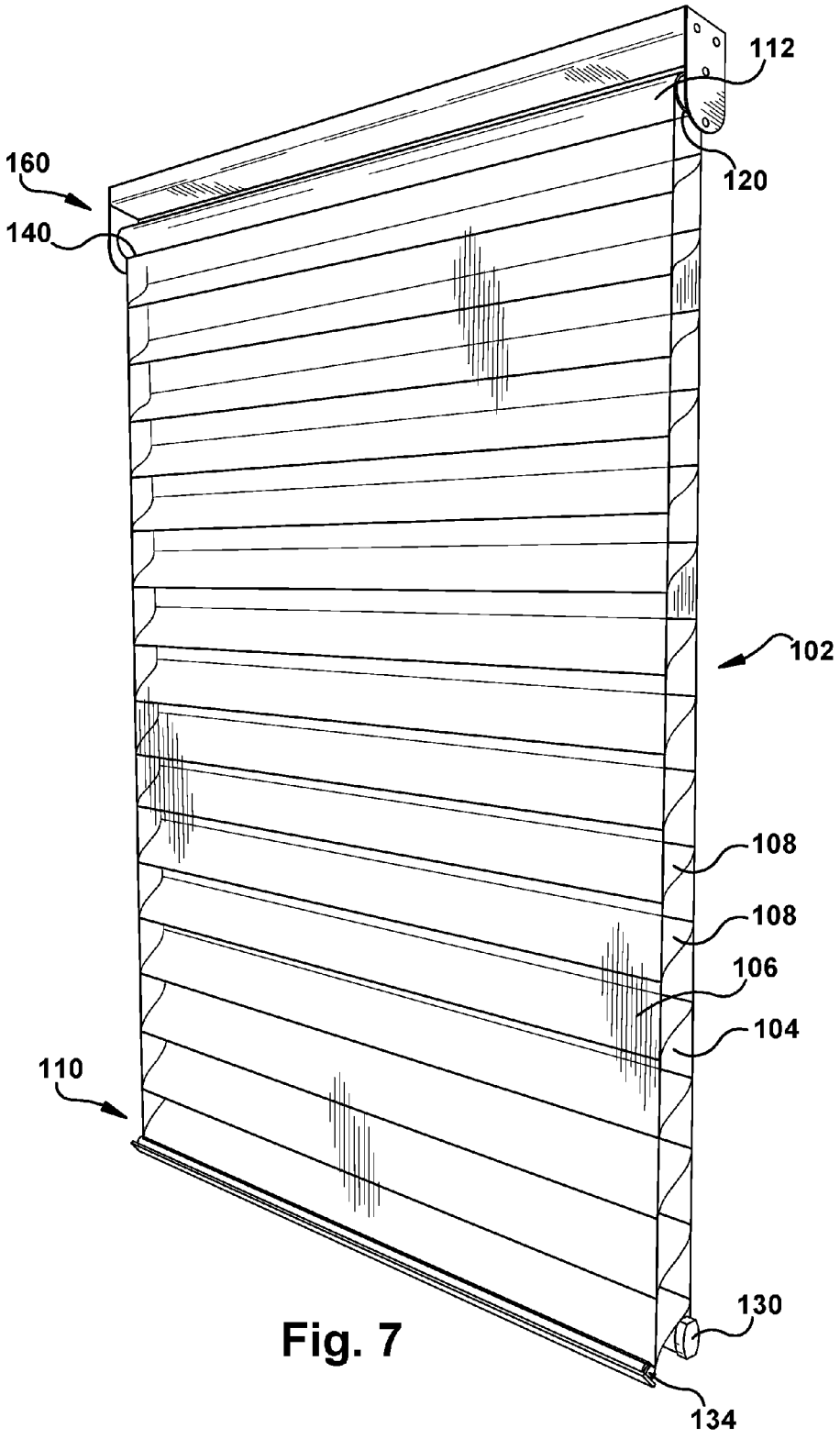
FIG. 7 shows a perspective view of a fabric venetian window shade assembly in one of a plurality of fully deployed, at least partially transparent positions (mostly non-transparent) according to embodiments of the present disclosure.

Turning now to FIG. 7, actuation system 110 with window shade 102 retracted onto roller 112 is shown. As shown in FIG. 6, window shade 102 can be attached to roller 112 at single bond line 140 positioned substantially at a tangency of first and/or second facings 104, 106 when vanes 108 are positioned in a substantially parallel orientation to the planes of first and second facings 104, 106. From this position, a user can grip second bottom rail 136 protruding from roller 112 to extend window shade 102. First bottom rail 130, in this position, can be positioned between roller 112 and second bottom rail 136, with first bottom rail 130 resting on an external fixture (e.g., a bracket) to hold window shade 102 in place and position second bottom rail 136 below actuation system 110.

Additional features of window shade assembly 100 in embodiments of the present disclosure are also shown in FIG. 7 and discussed herein. The diameter of roller 112 and the spacing of catches in spring-loaded ratchet 120 can be predetermined such that at least one catch and release setpoint of spring-loaded ratchet 120 is within a full rotation of roller 112. Further embodiments of window shade assembly 100 can include multiple catch and release set points within actuation system 100. Specifically, each catch and release setpoint of actuation system 110 can be create a different angling of vanes 108 relative to first and second facings 104, 106 ranging from, e.g., a substantially parallel angling to a substantially perpendicular angling. Through multiple catch and release setpoints, spring-loaded bracket 120 can position roller 112 and window shade 102 in a plurality of positions. In a retracted position corresponding to one catch and release setpoint, window shade 102 can be fully rolled onto roller 112 (i.e., FIG. 6). In one of several partially deployed, non-transparent positions (i.e., FIG. 2) corresponding to respective catch and release setpoints. In each one of the partially deployed, non-transparent positions, window shade 102 can be partially deployed from roller 112 with first and second facings 104, 106 being substantially parallel with vanes 108 and thereby causing window shade 102 to be non-transparent (i.e., translucent or opaque).

One catch and release setpoint of spring-loaded bracket 120 can correspond to a fully deployed, non-transparent position (i.e., shown in FIG. 1). This position may correspond to the last setpoint of actuation system 110 and may be positioned at a substantially full rotation of roller 112. In the fully deployed, non-transparent position, window shade 102 can be fully deployed from roller 112 and the first and second faces 104, 106 can be substantially parallel with vanes 108 such that window shade 102 is non-transparent (i.e., translucent or opaque). Another group of positions for window shade 102 can include several fully deployed, at least partially transparent positions (FIGS. 4, 5, 7). In a fully deployed, at least partially transparent position, window shade 102 can fully deployed from roller 102, and first and second faces 104, 106 can be non-parallel with vanes 108. This position can allow light to pass through window shade 102 between vanes 108. Window shade 102 can be switched between non-transparent and at least partially transparent positions, e.g., through a user applying a force to first bottom rail 130 to move first facing 104.

In addition to window shade assembly 100, embodiments of the present disclosure include window shade 102 with first and second facings 104, 106 coupled with vanes 108 and actuation system 110 as shown in FIG. 7. In an embodiment, first facing 104 can be oriented to face a window, and second facing 106 can be oriented to face internally (i.e., into a room or particular space). Other embodiments of the present disclosure can relate to actuation system 110 of window shade assemblies 100 which include window shade 102, first and second facings 104, 106, and vanes 108. Spring-loaded ratchet 120 of actuation system 110 can be coupled to roller 112 at single bond line 140, with window shade 102 being rollably attached to roller 112 and spring-loaded ratchet 120 being operable to position window shade 102 in any one of the several positions discussed herein (e.g., retracted positions, partially deployed non-transparent positions, a fully deployed non-transparent position, and/or fully deployed, partially transparent positions, etc.)

Whether provided in the form of a separate activation system or a complete assembly with an associated shading material, embodiments of the disclosure can provide a safe, convenient, cordless actuation system for window shades, as discussed herein and shown in the accompanying FIGS. 1-7. Advantages of the embodiments described herein include low manufacturing costs comparable or even less than manual clutch systems, a simple installation or removal process, an unobtrusive appearance, reliable use over long periods, and the reduced requirement for a side-gap between the shade material and a window, e.g., by omitting the use of a loop-cord and clutch system, as found in a conventional window shade assembly. Embodiments of the present invention also provide a safe and convenient, cordless actuation system for fabric, venetian shades on rollers. The system described herein has cost near to that of manual clutch systems, with easy installation and unobtrusive appearance, with reliable ease of use, and with reduced requirement for a side-gap between shade and window opening.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. An actuation system configured to operate a double panel window shading including opposing first and second facings coupled by a plurality of vanes, said actuation system comprising:

a roller configured to receive the opposing first and second facings;

a ratcheting mechanism mechanically coupled to at least the second facing through said roller; and a grip coupled exclusively to a lower end of the second facing, wherein, in response to a downward force being applied to said grip, said downward force is applied directly to the second facing without being applied directly to the first facing to adjust a position of the opposing first and second facings and an orientation of the plurality of vanes, and wherein said ratcheting mechanism is further configured to selectively maintain the position of the opposing first and second facings and the orientation of the plurality of vanes relative to the opposing first and second facings, and selectively release the ratcheting mechanism to retract the double panel window shading.

2. The actuation system of claim 1, wherein the grip comprises a bottom rail coupled to said second facing.

3. The actuation system of claim 1, further comprising a bottom rail coupled exclusively to a lower end of the second facing, without being coupled to the first facing of the double panel window shading.

4. The actuation system of claim 1, wherein said ratcheting mechanism includes a plurality of catches therein, each catch of said plurality of catches being configured to selectively maintain the orientation of the plurality of vanes relative to the first and second facings, wherein a diameter of said roller, a spacing of said plurality of catches of said ratcheting mechanism, and a width of the plurality of vanes are sized such that one rotation of said roller includes at least one catch of said ratcheting mechanism.

5. The actuation system of claim 1, wherein said ratcheting mechanism maintains the roller and the first and second facings of the double panel window shading in one of a plurality of positions including:

a retracted position in which the double panel window shading is fully rolled onto said roller;

a plurality of partially deployed, non-transparent positions in which the double panel window shading is partially deployed from said roller and the first and second facings are substantially parallel with the plurality of vanes so the double panel window shading is non-transparent;

a fully deployed, non-transparent position in which the double panel window shading is fully deployed from said roller and the first and second facings and the plurality of vanes are substantially parallel so the double panel window shading is non-transparent; and a plurality of fully deployed, at least partially transparent positions in which the double panel window shading is fully deployed from said roller and the first and second facings are not parallel with the plurality of vanes so the double panel window shading is at least partially transparent.

6. A window shading assembly comprising:

a roller having first and second opposing radial sides;

a first facing coupled to said first side of said roller;

a second facing coupled to said second side said roller;

a plurality of vanes extending across and coupled between said first and second facings; and a ratcheting mechanism coupled to said roller;

wherein said second facing is coupled to said roller to actuate said ratcheting mechanism upon a downward force being applied exclusively to said second facing to adjust a position of the first and second facings and an orientation of the plurality of vanes, and wherein said ratcheting mechanism is further configured to selectively maintain the position of the first and second facings and the orientation of the plurality of vanes relative to the first and second facings, and release to reset the position of the first and second facings and the orientation of the plurality of vanes.

7. The window shading assembly of claim 6, wherein said ratcheting mechanism includes a plurality of catches therein, each catch of said plurality of catches being configured to selectively maintain the orientation of said plurality of vanes relative to said first and second facings, wherein a diameter of said roller, a spacing of said plurality of catches of said ratcheting mechanism, and a width of said plurality of vanes are sized such that one rotation of said roller includes at least one catch of said ratcheting mechanism.

8. The window shading assembly of claim 6, wherein said ratcheting mechanism maintains said roller and said first and second facings of the window shading assembly in one of a plurality of positions including:

a retracted position in which the window shading assembly is fully rolled onto said roller;

a plurality of partially deployed, non-transparent positions in which the window shading assembly is partially deployed from said roller and said first and second facings are substantially parallel with said plurality of vanes so the window shading assembly is non-transparent;

a fully deployed, non-transparent position in which the window shading assembly is fully deployed from said roller and said first and second facings and the plurality of vanes are substantially parallel so the window shading assembly is non-transparent; and a plurality of fully deployed, at least partially transparent positions in which the window shading assembly is fully deployed from said roller and the first and second facings are not parallel with the plurality of vanes so the window shading assembly is at least partially transparent.

9. The window shading assembly of claim 6, further comprising a grip coupled exclusively to the second facing.

10. A window shading assembly comprising:

a roller having first and second opposing radial sides;

a shade element having a top end coupled to one of said first and second opposing radial sides of said roller, and a bottom end having a grip, wherein the shade element includes a plurality of vanes; and a ratcheting mechanism coupled to said roller for controlling the position of said shade element;

wherein said shade element is coupled to said roller at one of said first and second opposing radial sides of said roller so that application of a downward force to said grip directs force to said one of said first and second opposing radial sides of said roller to actuate said ratcheting mechanism to control the position of said shade element and an orientation of said plurality of vanes, and wherein said ratcheting mechanism is further configured to selectively maintain the position of said shade element and the orientation of said plurality of vanes and release to retract the shade element.

11. The window shading assembly of claim 10, wherein said shade element further includes a first facing and an opposing second facing therein, and wherein said grip is coupled exclusively to the first facing of said shade element without being coupled to said second facing.

12. The window shading assembly of claim 10, wherein said shade element further includes a first facing and an opposing second facing therein.

13. The window shading assembly of claim 11, wherein said ratcheting mechanism is further configured to control a position of the second facing relative to the first facing.

14. A method for operating a window shading including opposing first and second facings coupled to opposite radial sides of a roller, and a plurality of vanes extending between said first and second facings, said method comprising:

applying a first downward force to a grip on the window covering to direct the first downward force to the second facing and one radial side of the roller to actuate a ratcheting mechanism coupled to the roller to adjust a position of the opposing first and second facings and an orientation of said plurality of vanes relative to the opposing first and second facings, wherein the window shading includes a ratcheting mechanism configured to selectively maintain a selected position of the opposing first and second facings and orientation of the plurality of vanes relative to the opposing first and second facings in response to the first downward force; and applying a second downward force to the grip to release the ratcheting mechanism and thereby retract the window shading from the selected position of the opposing first and second facings and orientation of the plurality of vanes relative to the opposing first and second facings.

15. The method of claim 14, wherein said grip is coupled exclusively to the second facing of the window shading.

16. The method of claim 14, wherein applying said downward force to said grip on the window covering adjusts said ratchet mechanism to one of a plurality of positions.

17. The method of claim 16, wherein said plurality of positions includes:

a retracted position in which the window shading assembly is fully rolled onto said roller;

a plurality of partially deployed, non-transparent positions in which the window shading assembly is partially deployed from said roller and said first and second facings are substantially parallel with said plurality of vanes so the window shading assembly is non-transparent;

a fully deployed, non-transparent position in which the window shading assembly is fully deployed from said roller and said first and second facings and the plurality of vanes are substantially parallel so the window shading assembly is non-transparent; and a plurality of fully deployed, at least partially transparent positions in which the window shading is fully deployed from said roller and the first and second facings are not parallel with the plurality of vanes so the window shading is at least partially transparent.

18. The method of claim 14, wherein said ratcheting mechanism includes a plurality of catches therein, each catch of said plurality of catches being configured to selectively maintain the orientation of the plurality of vanes relative to the first and second facings, and wherein said applying of said first downward force actuates said opposing first and second facings to move to the selected position, one of the plurality of catches of the ratcheting mechanism being configured to selectively maintain said opposing first and second facings in the selected position.

* * * * *